US010828761B2

(12) United States Patent
Dill et al.

(10) Patent No.: US 10,828,761 B2
(45) Date of Patent: Nov. 10, 2020

(54) POWERED FASTENER DRIVING TOOL

(71) Applicant: Illinois Tool Works Inc., Glenview, IL (US)

(72) Inventors: Michael C. Dill, Elk Grove Village, IL (US); Chung-Yi Lee, New Taipei (TW)

(73) Assignee: Illinois Tool Works Inc., Glenview, IL (US)

( * ) Notice: Subject to any disclaimer, the term of this patent is extended or adjusted under 35 U.S.C. 154(b) by 359 days.

(21) Appl. No.: 15/665,513

(22) Filed: Aug. 1, 2017

(65) Prior Publication Data

US 2018/0043519 A1 Feb. 15, 2018

Related U.S. Application Data

(60) Provisional application No. 62/375,189, filed on Aug. 15, 2016.

(51) Int. Cl.
*B25C 1/12* (2006.01)
*B25C 1/14* (2006.01)
(Continued)

(52) U.S. Cl.
CPC ..... *B25C 1/123* (2013.01); *B25C 1/06* (2013.01); *B25C 1/10* (2013.01); *B25C 1/143* (2013.01);
(Continued)

(58) Field of Classification Search
CPC ..... B25C 1/123; B25C 1/10; B25C 1/163; B25C 7/00; B25C 1/06; B25C 1/186; B25C 1/143
See application file for complete search history.

(56) References Cited

U.S. PATENT DOCUMENTS 5,170,922 A * 12/1992 Ehmig ..... B25C 1/186 227/8
5,699,948 A 12/1997 Lee
(Continued)

FOREIGN PATENT DOCUMENTS

TW 526 944 8/2016

OTHER PUBLICATIONS

International Search Report and Written Opinion for International Application No. PCT/US2017/045499, dated Nov. 17, 2017 (14 pages).

(Continued)

*Primary Examiner* — Hemant Desai
*Assistant Examiner* — Christopher Robin Kim
(74) *Attorney, Agent, or Firm* — Neal, Gerber & Eisenberg LLP

(57) ABSTRACT

A powered fastener driving tool such as a powder-actuated tool including a housing assembly including a side wall having a first outer section, a raised section, and a recessed section, the raised section including a rim that extends in an outermost plane of a side wall of the housing and a spring-loaded slidable power setting switch partially positioned in and partially extending from the housing. The spring-loaded slidable power setting switch includes a depressible button movable from a resting position in which an outer surface of the button extends outwardly beyond the plane in which the outer surface of the rim lies to a depressed position in which the outer surface of the button extends in a same or substantially same plane in which the outer surface of the rim lies.

13 Claims, 16 Drawing Sheets

(51) Int. Cl.

| | |
|---|---|
| ***B25C 1/10*** | (2006.01) |
| ***B25C 1/06*** | (2006.01) |
| ***B25C 1/16*** | (2006.01) |
| ***B25C 1/18*** | (2006.01) |
| ***B25C 7/00*** | (2006.01) |

(52) U.S. Cl.
CPC ..... *B25C 1/163* (2013.01); *B25C 1/186* (2013.01); *B25C 7/00* (2013.01)

(56) References Cited

U.S. PATENT DOCUMENTS

| | | | | |
|---|---|---|---|---|
| 5,732,869 | A * | 3/1998 | Hirtl | B25C 1/143 227/10 |
| 2002/0104867 | A1* | 8/2002 | Wohlwend | B25C 1/18 227/9 |
| 2010/0258609 | A1 | 10/2010 | Lee | |
| 2013/0255981 | A1* | 10/2013 | Noto | B25F 5/00 173/20 |
| 2017/0266797 | A1* | 9/2017 | Lee | B25C 1/18 |
| 2017/0368672 | A1* | 12/2017 | Meyer | B25C 1/06 |

OTHER PUBLICATIONS

Cobra Tool Operator's Safety & Operating Instruction Manual, by Ramset® Fastening Systems, revised Aug. 2007 (16 pages).

Ramset® 2017 Product Catalog, downloaded from the Internet at http://www.ramset.com/marketing-support/literature, available 2017 (50 pages).

* cited by examiner

POWERED FASTENER DRIVING TOOL

PRIORITY

This application claims priority to and the benefit of U.S. Provisional Patent Application Ser. No. 62/375,189, filed Aug. 15, 2016, the entire contents of which are incorporated herein by reference.

BACKGROUND

Powered fastener driving tools are well known and commercially widely used throughout North America and other parts of the world. Powered fastener driving tools are typically electrically powered, pneumatically powered, combustion powered, or powder-actuated. Powered fastener driving tools are typically used to drive fasteners (such as nails, staples, and the like) to connect a first material, item, or workpiece to a second material, item, or workpiece.

Various known powered fastener driving tools include: (a) a housing; (b) a power source or supply assembly in, connected to, or supported by the housing; (c) a fastener supply assembly in, connected to, or supported by the housing; (d) a fastener driving assembly in, connected to, or supported by the housing; (e) a trigger mechanism partially in, connected to, or supported by the housing; (f) a power setting assembly in, connected to, or supported by the housing; and (g) a workpiece contacting element (sometimes referred to herein as a "WCE") connected to or supported by the housing. The WCE is configured to engage or contact a workpiece and to operatively work with the trigger mechanism such that the WCE needs to be depressed or moved inwardly a predetermined distance with respect to the housing before activation of the trigger mechanism causes actuation of the power fastener driving tool.

Powered fastener driving tools typically have two different types of operational modes and one or more mechanisms that enable the operator to optionally select one of the two different types of operational modes that the operator desires to use for driving the fasteners. One operational mode is known in the industry as the sequential or single actuation operational mode. In this operational mode, depression or actuation of the trigger mechanism will not (by itself) initiate the actuation of the powered fastener driving tool and the driving of a fastener into the workpiece unless the WCE element is sufficiently depressed against the workpiece. In other words, to operate the powered fastener driving tool in accordance with the sequential or single actuation operational mode, the WCE element must first be depressed against the workpiece followed by the depression or actuation of the trigger mechanism. Another operational mode is known in the industry as the contact actuation operational mode. In this operational mode, the operator can maintain the trigger mechanism at or in its depressed position, and subsequently, each time the WCE is in contact with, and sufficiently pressed against the workpiece, the power fastener driving tool will actuate, thereby driving a fastener into the workpiece.

As mentioned above, various known powered fastener driving tools are powder-actuated. Powder-actuated tools are typically used in construction and manufacturing to attach one or more items or materials to hard substrates (such as steel or concrete) using fasteners. Powder-actuated tools typically eliminate the need to drill holes with a concrete drill bit or to use anchors and screws for such fastening applications. For example, powder-actuated tools are commonly used by electricians to attach conduit clips, electrical junction boxes, and various other items to concrete, masonry, and steel surfaces.

Powder-actuated tools use controlled explosions created by small chemical propellant charges to propel the fastener through both materials. Powder-actuated tools are typically either high velocity or low velocity. High velocity powder-actuated tools typically cause the propellant charge to act directly on or directly drive the fastener. Low velocity powder-actuated tools typically cause the propellant charger to act on a piston that in turn acts on or drives the fastener. Fasteners used by powder-actuated tools are typically nails made of high quality, hardened steel, although they may be made from other materials.

Like other powered fastener driving tools mentioned above, known powder-actuated tools typically have a housing that supports a trigger that must be actuated to cause the firing pin of the powder-actuated tool to reach the load to fire it. Certain known powder-actuated tools also have a WCE element in the form of a muzzle safety interlock. If the muzzle is not pressed against a surface with sufficient force, the tool blocks the firing pin from reaching the load to fire it. This prevents the powder-actuated tool from discharging in an unsafe manner and causing the fastener to become an undesired projectile. Like other powered fastener driving tools mentioned above, various known powder-actuated tools also have a power setting switch supported by the housing. The power setting switch enables the operator to set the amount of power of the tool (from a range of different power settings) or the amount of force at which the tool will propel or drive the fastener.

Certain known powder-actuated tools have a spring-loaded slidable power setting switch supported by the housing and extending outwardly from the exterior circumferential surface of one side of the housing. This spring-loaded slidable power setting switch generally includes a depressible button, a slider that supports the button, a locking member, and a spring. When an operator desires to change the power setting on this powder-actuated tool, the operator pushes the button inwardly against the force of the spring to cause the locking member to disengage from the housing and release or unlock the slider from a locked position. This enables the operator to slide the slider relative to the housing to change the power setting on the powder-actuated tool. When the slider is moved to the new position, the operator releases the button, and the spring causes the locking member to move to another locked position to prevent undesired further movement of the slider.

It has been found that such spring-loaded slidable power setting switches can be damaged or break during repeated and regular use of the powder-actuated tools. More specifically, during regular use, an operator often puts down and picks up such powder-actuated tools numerous times during each work day. During regular use, an operator may also unintentionally drop the powder-actuated tool on its side where the spring-loaded slidable power setting switch is typically located. This repeated and sometimes forceful contact with the ground, a table, or other supporting surface can cause damage to or break part or the entire spring-loaded slidable power setting switch. Such damage or breakage makes the powder-actuated tool less functional, partially inoperable, or completely inoperable.

This damage is incurred in part because the engagement of the spring-loaded slidable power setting switch, and particularly the button with the ground, a table, or other supporting surface that causes the button to move inwardly a greater extent or greater distance than normally permitted by the spring. This force breaks the switch or a component of the switch such as the button, the slider, or the locking member.

Accordingly, there is a need to provide a powered fastener driving tools and particularly a powder-actuated tool that solves this problem.

SUMMARY

Various embodiments of the present disclosure provide a powered fastener driving tool and particularly a powder-actuated tool that solves the above problem by providing an alternatively positioned spring-loaded slidable power setting switch relative to the housing and a protective rim extending from the housing. The spring-loaded slidable power setting switch and the button of the spring-loaded slidable power setting switch are positioned in the housing relative to the rim such that when the button is in a depressed position, the button is aligned with the rim to prevent the button from extending too far inwardly when the powder-actuated tool engages the ground, a table, or other supporting surface.

In various embodiments of the present disclosure, a powered fastener driving tool such as a powder-actuated tool generally includes: (a) a housing assembly including a main compartment assembly and a handle assembly extending from the main compartment assembly; (b) a power supply assembly positioned in the housing assembly; (c) a fastener supply assembly configured to receive fasteners and positioned in the housing assembly; (d) a fastener driving assembly positioned in the housing assembly; (e) a trigger mechanism assembly supported by the handle assembly; (f) a workpiece contact element assembly supported by the housing assembly; and (g) a spring-loaded slidable power setting switch partially positioned in and partially extending from one side of the main compartment assembly.

The main compartment assembly includes a side wall having a first outer section, a raised section, and a recessed section. The raised section includes a rim that extends in an outermost plane of the side wall of the main compartment assembly. The spring-loaded slidable power setting switch includes a depressible button movable from (a) a resting position in which an outer surface of the button extends outwardly beyond the plane in which the outer surface of the rim lies to (b) a depressed position in which the outer surface of the button extends in a same or substantially same plane in which the outer surface of the rim lies.

This configuration prevents the button from extending too far inwardly when the a powered fastener driving tool such as the powder-actuated tool engages the ground, a table, or other supporting surface as further described below. This configuration prevents or minimizes damage to the powder-actuated tool that can occur due to repeated and/or forceful contact with the ground, a table, or other supporting surface and thus minimizes the likelihood that the a powered fastener driving tool such as the powder-actuated tool becomes less functional, partially inoperable, or completely inoperable from such contact or repeated contact.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
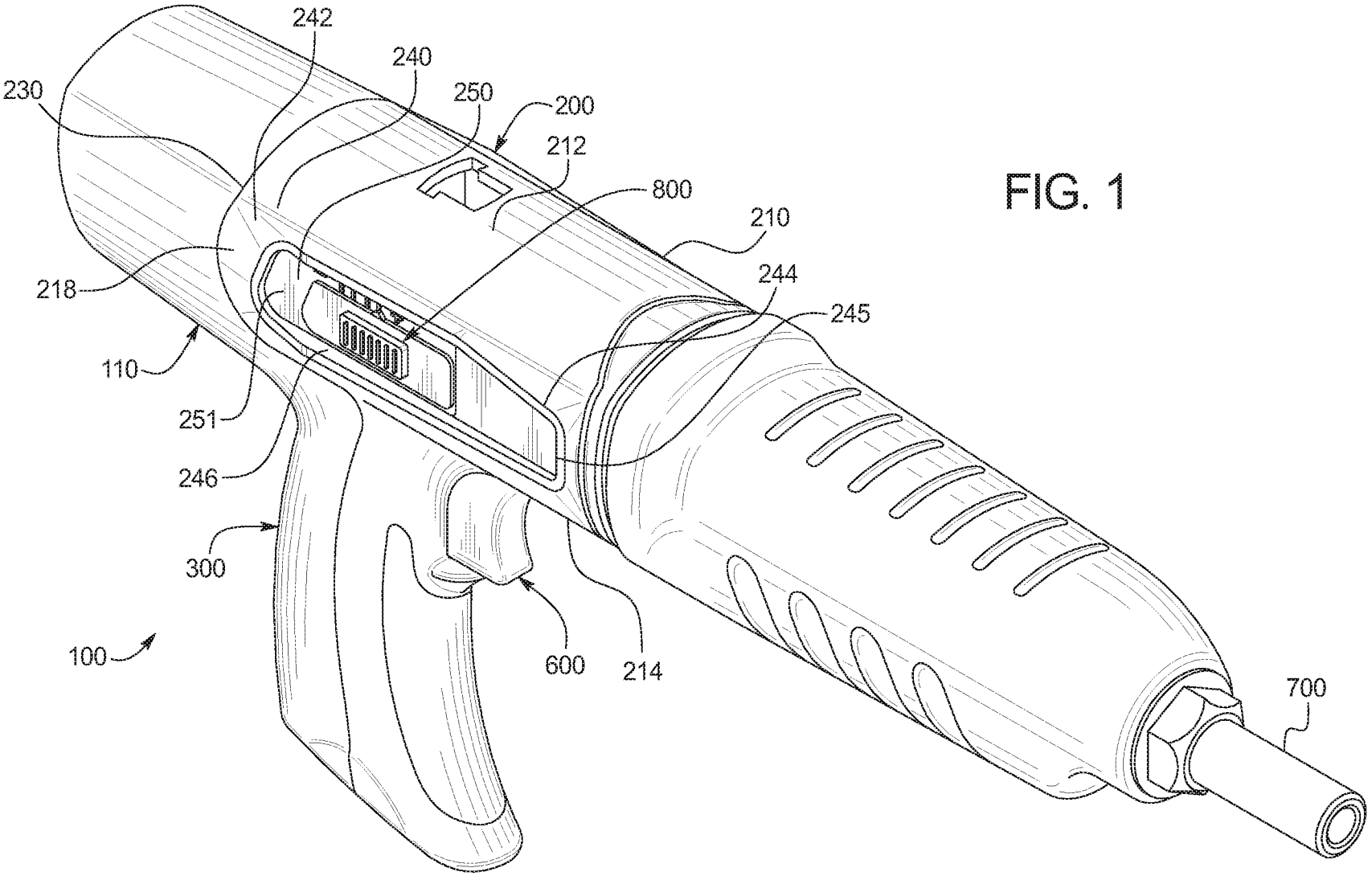
FIG. 1 is a front perspective view of a powered fastener driving tool and particularly a powder-actuated tool of one example embodiment of the present disclosure, showing the position of the spring-loaded slidable power setting switch with respect to the housing.

Referring now to the drawings, and particularly to FIGS. 1, 1A, 2, 3, 4, 5, 6, 7, 8, 9, 10, 11A, 11B, 12, and 13, the powered fastener driving tool of one example embodiment of the present disclosure is generally illustrated and indicated by numeral 100. The powered fastener driving tool in this illustrated embodiment is a powder-actuated tool. This example powder-actuated tool may be referred to herein as the powered fastener driving tool; the fastener driving tool, the driving tool, or the tool for brevity. Such abbreviations are not meant to limit the present disclosure in any manner.

The powered fastener driving tool and particularly the powder-actuated tool 100 of this illustrated example embodiment generally includes: (a) a housing assembly 110 including a main compartment assembly 200 and a handle assembly 300 extending from the main compartment assembly 200; (b) a power source or supply assembly (not shown) positioned in the housing assembly 110 and configured to use loads attached to a load strip that moves through the handle assembly 300 and main compartment assembly 200 as shown in FIG. 1A, the power source or supply assembly adjustable between a plurality of different power levels; (d) a fastener supply assembly configured to receive fasteners (not shown) and positioned in the housing assembly 110; (e) a fastener driving assembly (not shown) positioned in the housing assembly 110; (f) a trigger mechanism assembly 600 (partially shown) connected to or supported by the handle assembly 300 of the housing assembly 110; (g) a WOE assembly 700 connected to or supported by the housing assembly 110; and (h) a spring-loaded slidable power setting switch 800 partially positioned in and partially extending from the main compartment assembly 200 of the housing assembly 110.

More specifically, the housing assembly 110 includes a main compartment assembly 200 and a handle assembly 300 extending downwardly from the main compartment assembly 200. In this illustrated embodiment, the main compartment assembly 200 includes a generally tubular outer housing 210 including a top wall 212, a bottom wall 214, a left side wall 216, and a right side wall 218 integrally formed or connected.

Figure 1A:
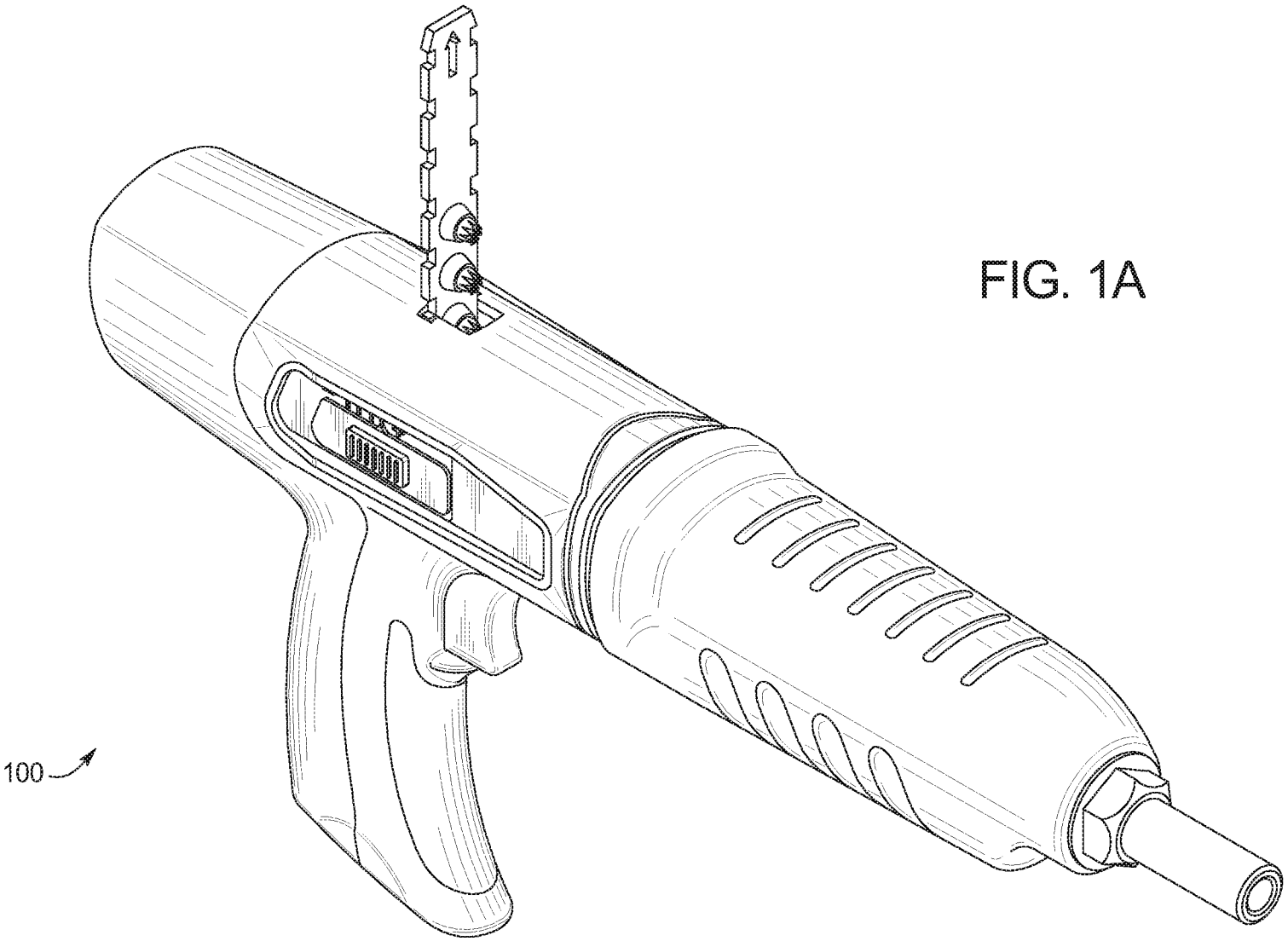
FIG. 1A is a front perspective view of a powered fastener driving tool and particularly a powder-actuated tool of one example embodiment of the present disclosure, and showing a load strip exiting the top of the housing.
Figure 2:
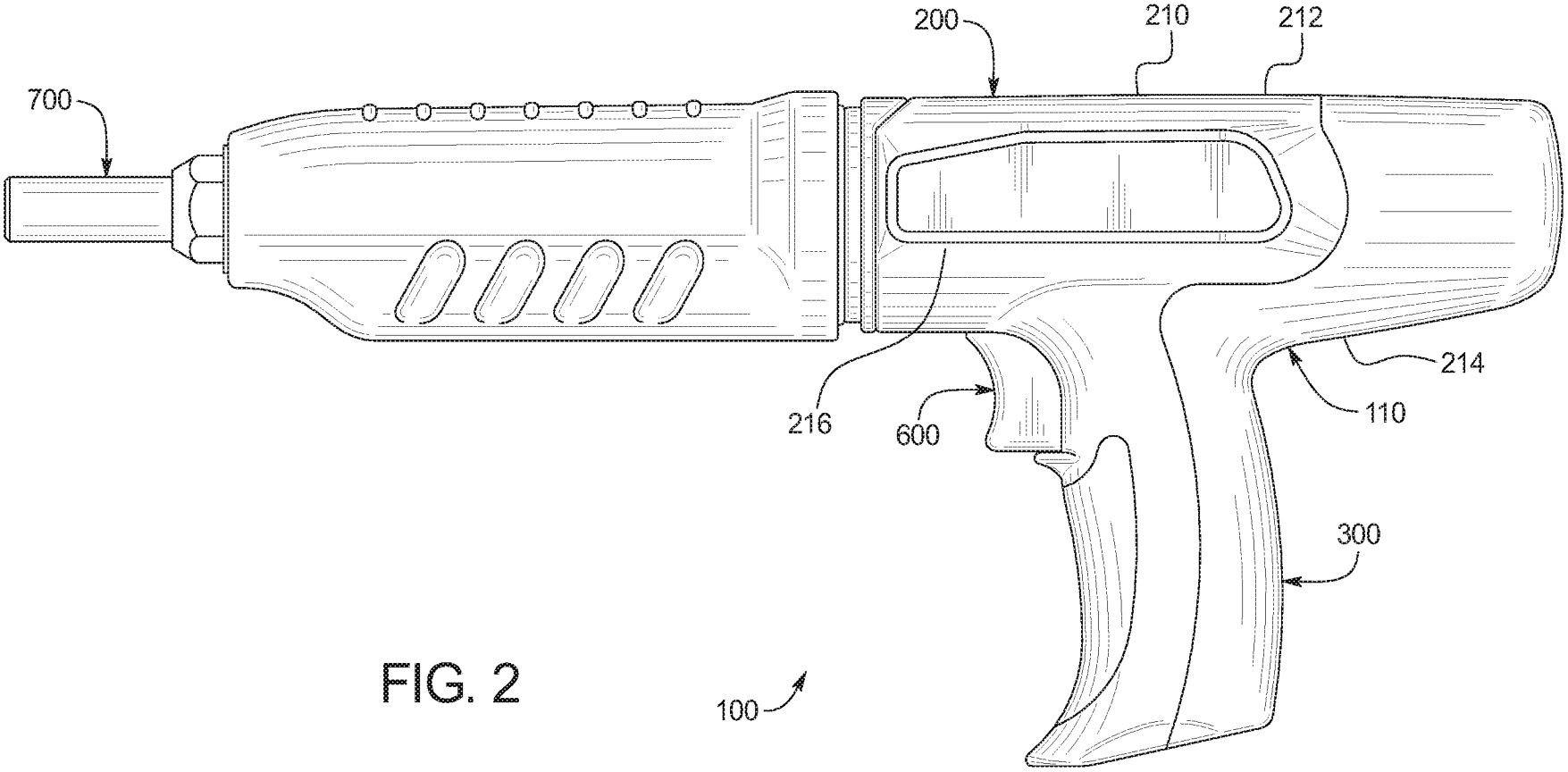
FIG. 2 is a left side view of the powder-actuated tool of FIG. 1.
Figure 3:
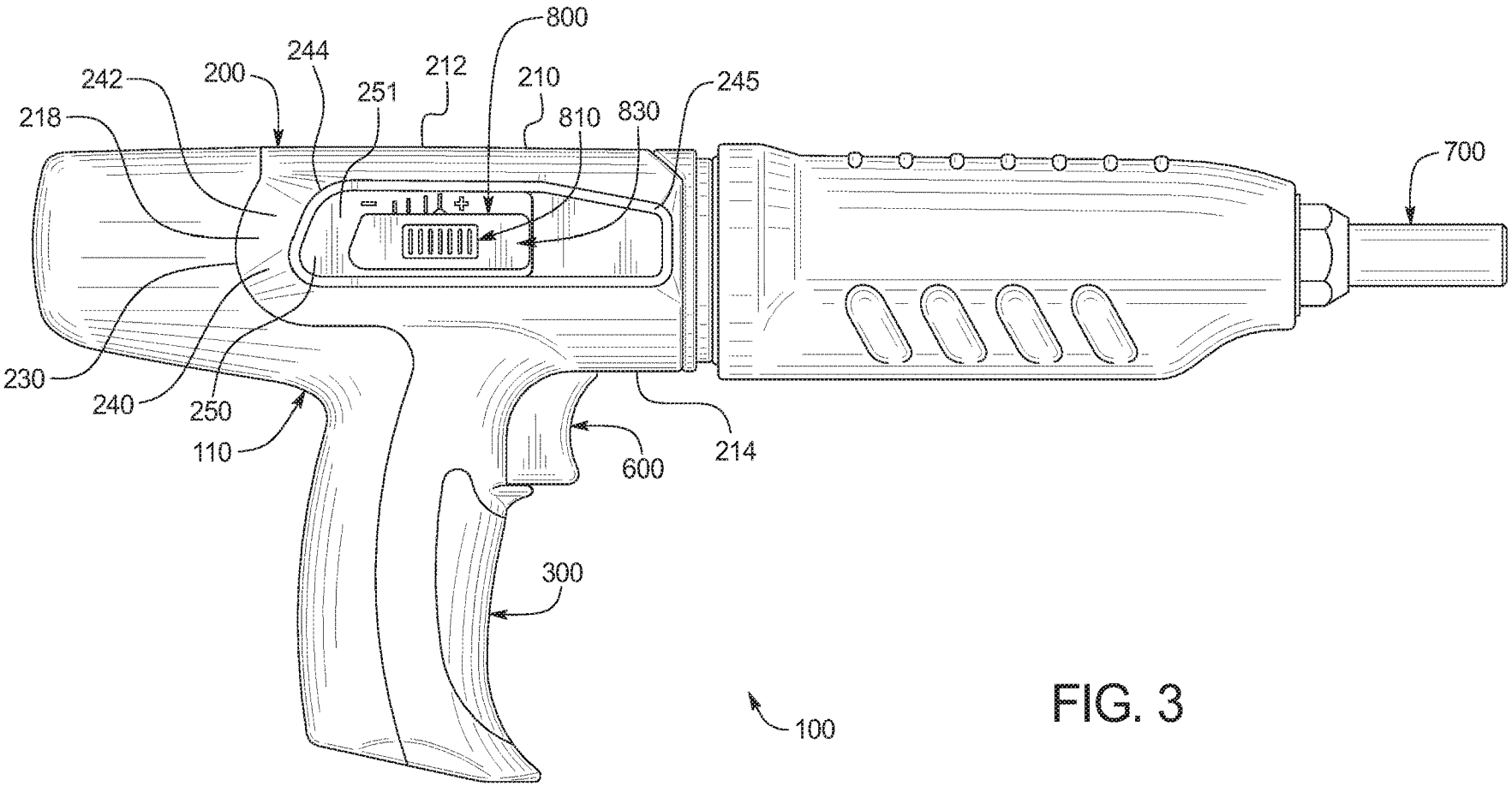
FIG. 3 is a right side view of the powder-actuated tool of FIG. 1, further showing the position of the spring-loaded slidable power setting switch with respect to the housing.
Figure 4:
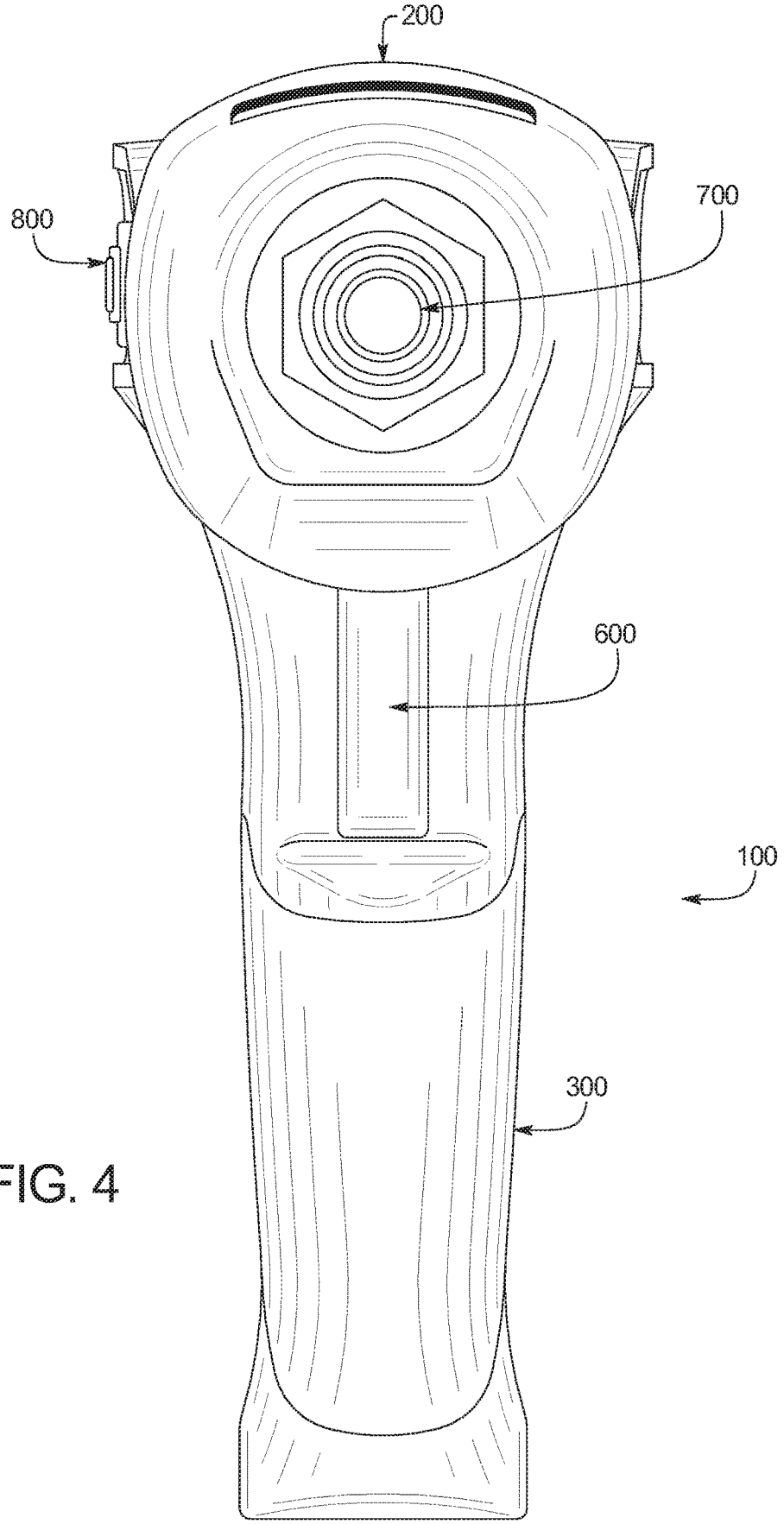
FIG. 4 is a front view of the powder-actuated tool of FIG. 1, further showing the position of the spring-loaded slidable power setting switch with respect to the housing.
Figure 5:
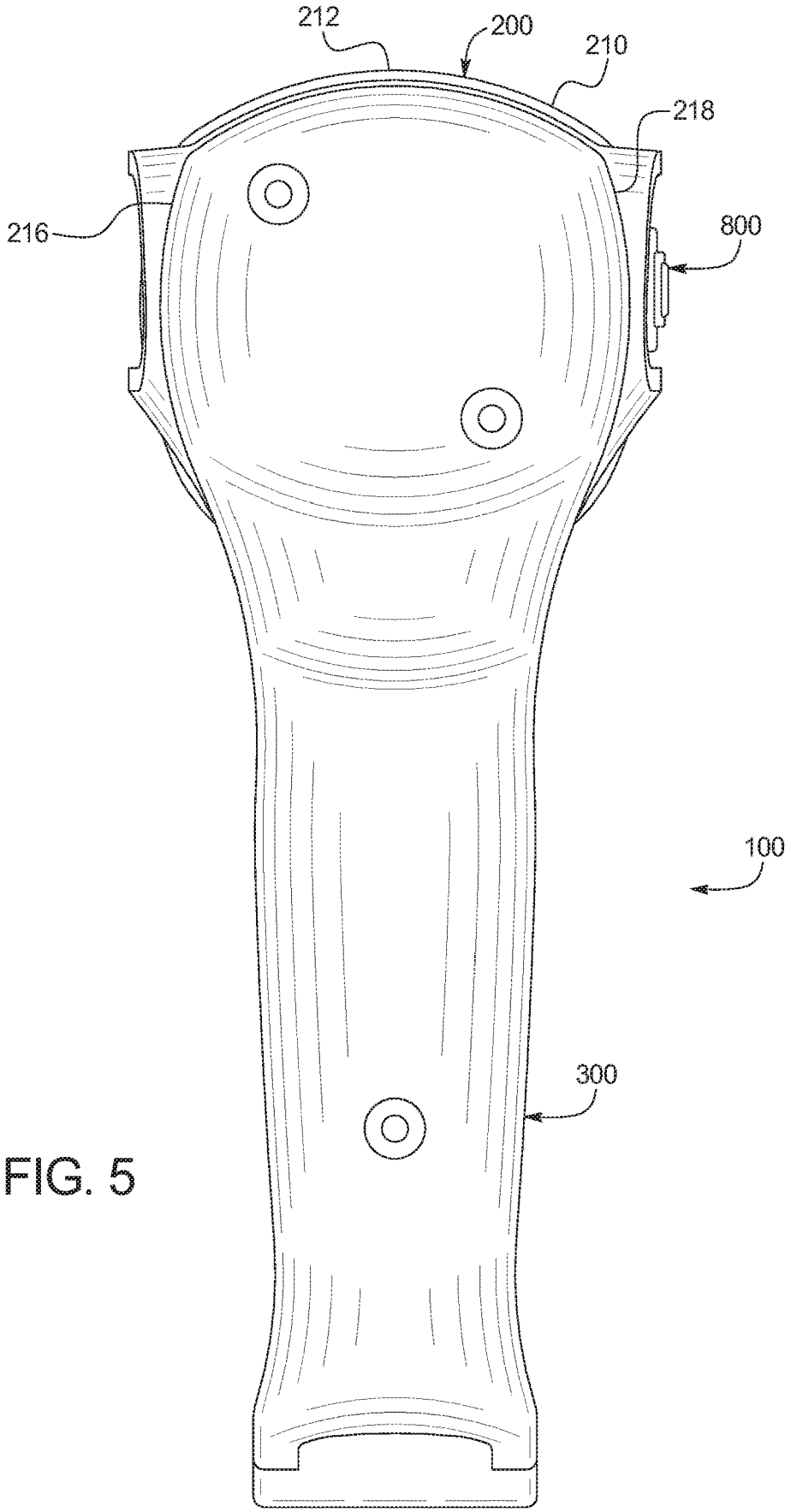
FIG. 5 is a rear view of the powder-actuated tool of FIG. 1, further showing the position of the spring-loaded slidable power setting switch with respect to the housing.
Figure 6:
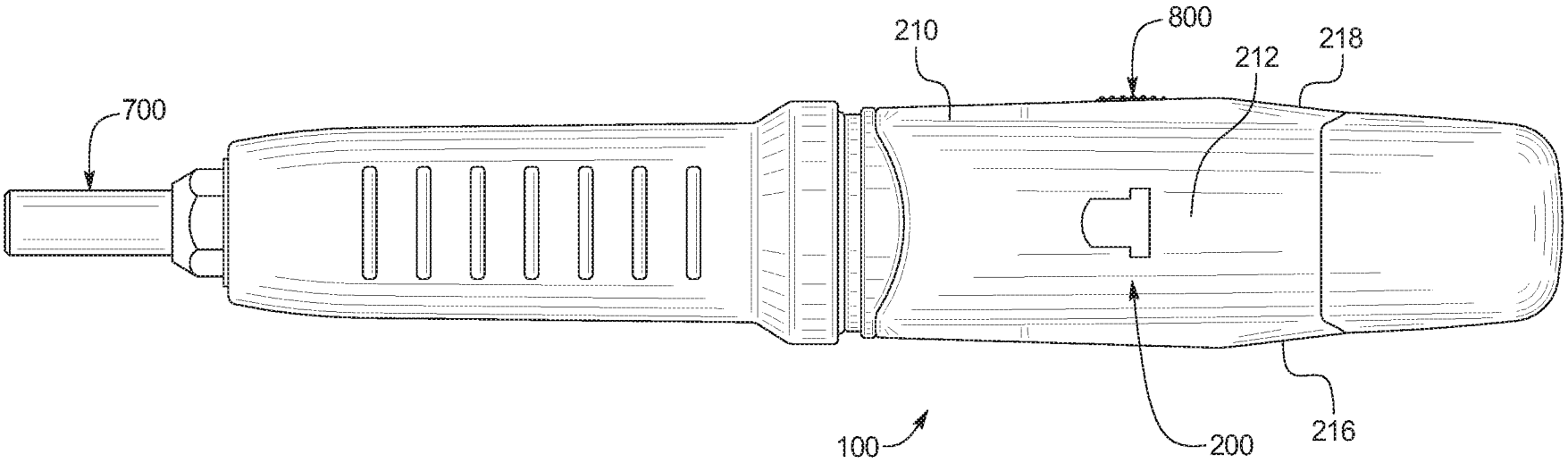
FIG. 6 is a top view of the powder-actuated tool of FIG. 1, further showing the position of the spring-loaded slidable power setting switch with respect to the housing.
Figure 7:
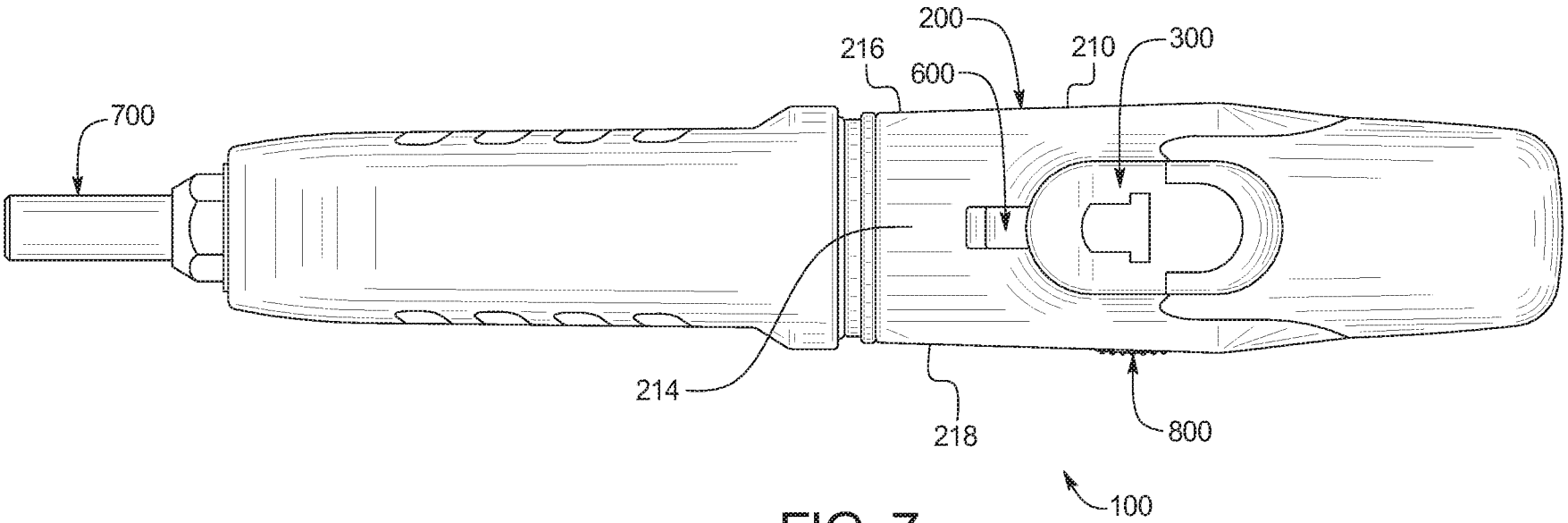
FIG. 7 is a bottom view of the powder-actuated tool of FIG. 1, further showing the position of the spring-loaded slidable power setting switch with respect to the housing.
Figure 8:
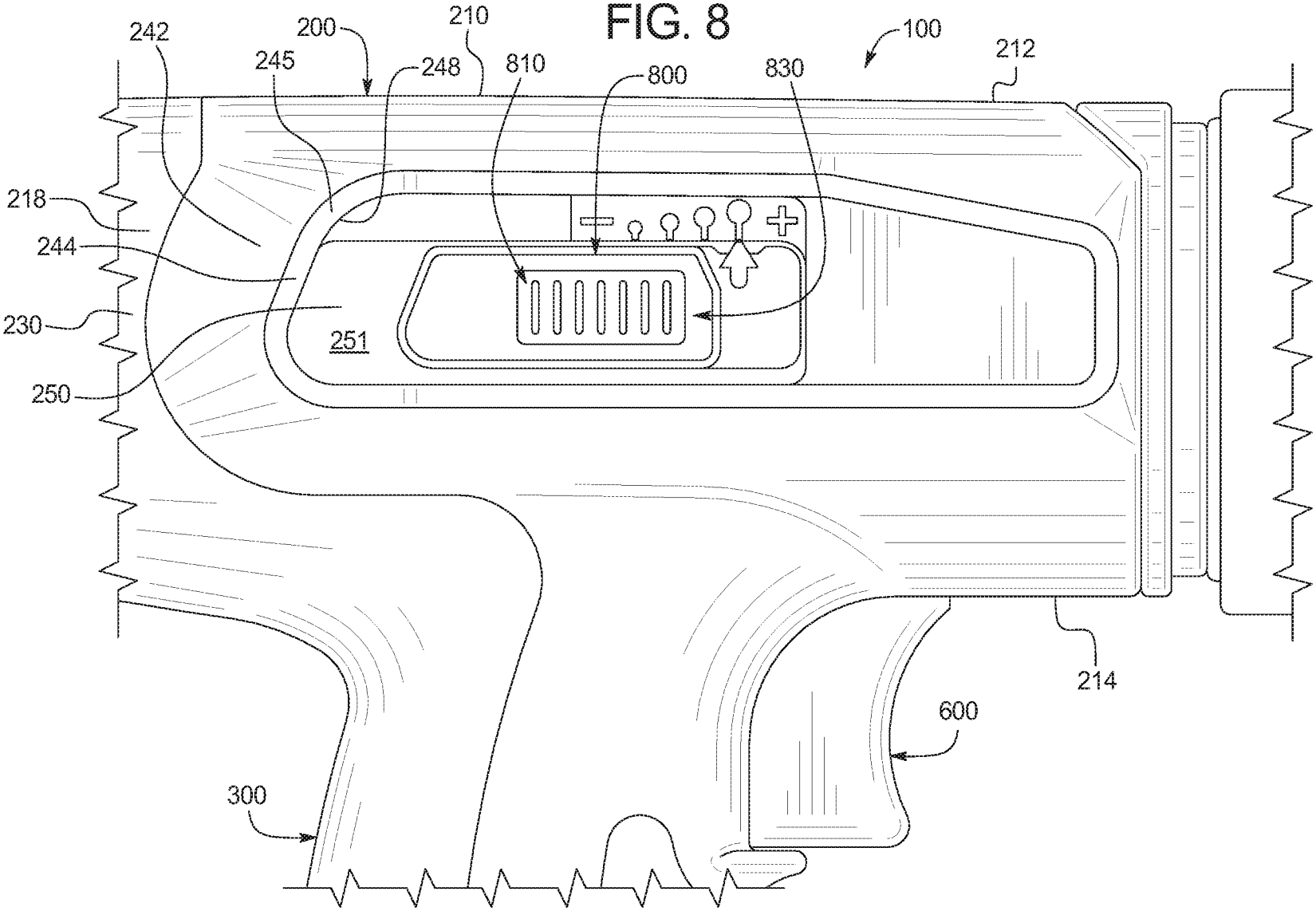
FIG. 8 is an enlarged fragmentary right side view of the powder-actuated tool of FIG. 1, further showing the position of the spring-loaded slidable power setting switch with respect to the housing.

As best seen in FIGS. 1, 3, and 8, the right side wall 218 includes a first outer section 230, a second or raised section 240, and a third or recessed section 250. The second or raised section 240 includes an outwardly-extending section 242 (inclined in this illustrated embodiment), a ridge or rim 244, and an inwardly-extending section 246. The outwardly-extending section 242 extends outwardly from the first outer section 230 to the ridge or rim 244. The inwardly-extending section 246 extends inwardly from the ridge or rim 244 to the third or recessed section 250. The ridge or rim 244 extends from the outermost edge of the outwardly-extending section 242 to the outermost edge of the inwardly-extending section 246. The outer surface 245 of the ridge or rim 244 extends in a first or outermost plane of the housing assembly 110 on the right side of the powder-actuated tool 100. This first or outer most plane is generally indicated by the dotted or phantom lines in FIGS. 11A and 11B.

Figure 9:
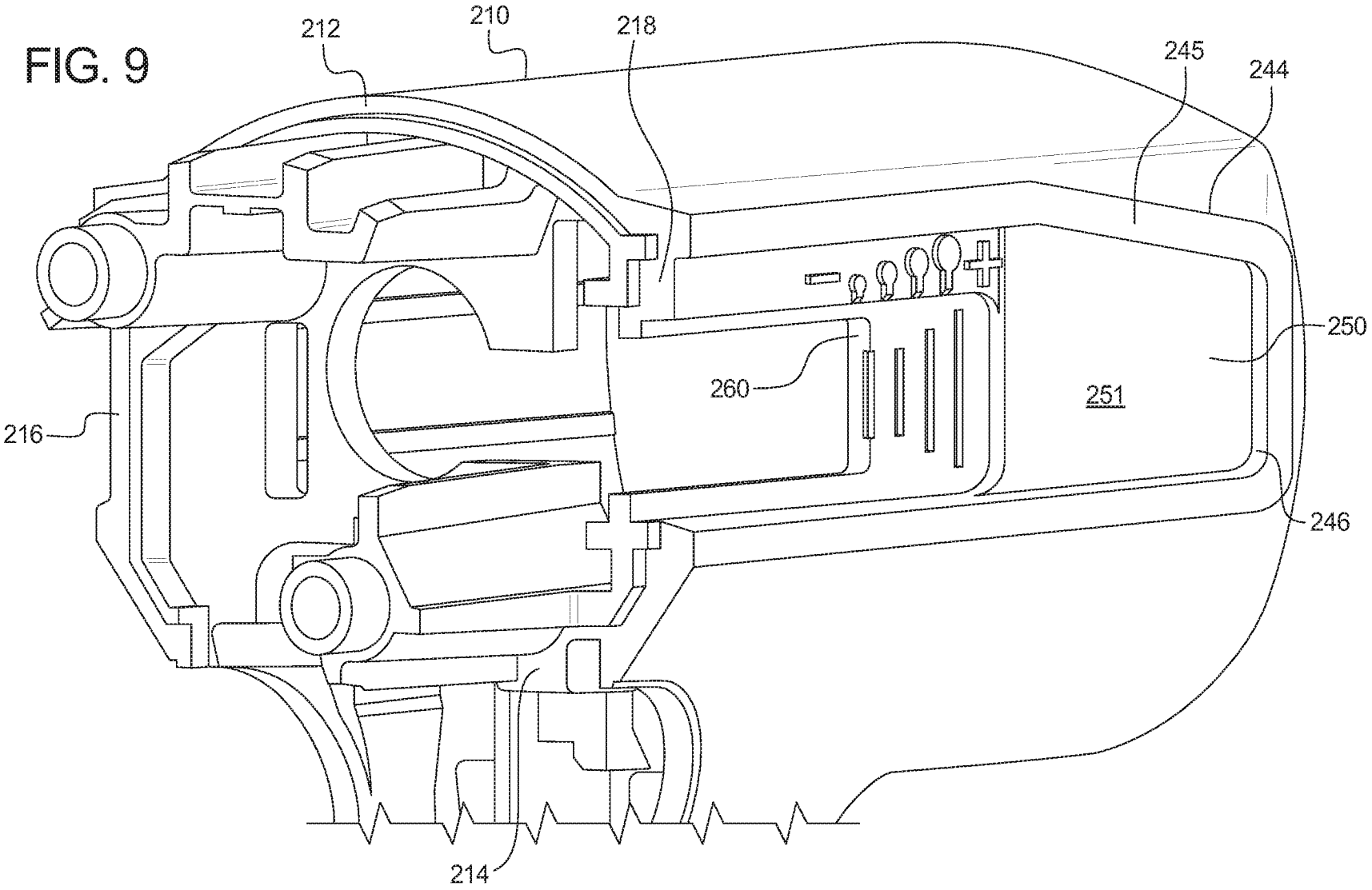
FIG. 9 is an enlarged fragmentary cross sectional view of the housing of the powder-actuated tool of FIG. 1 with the spring-loaded slidable power setting switch removed.
Figure 10:
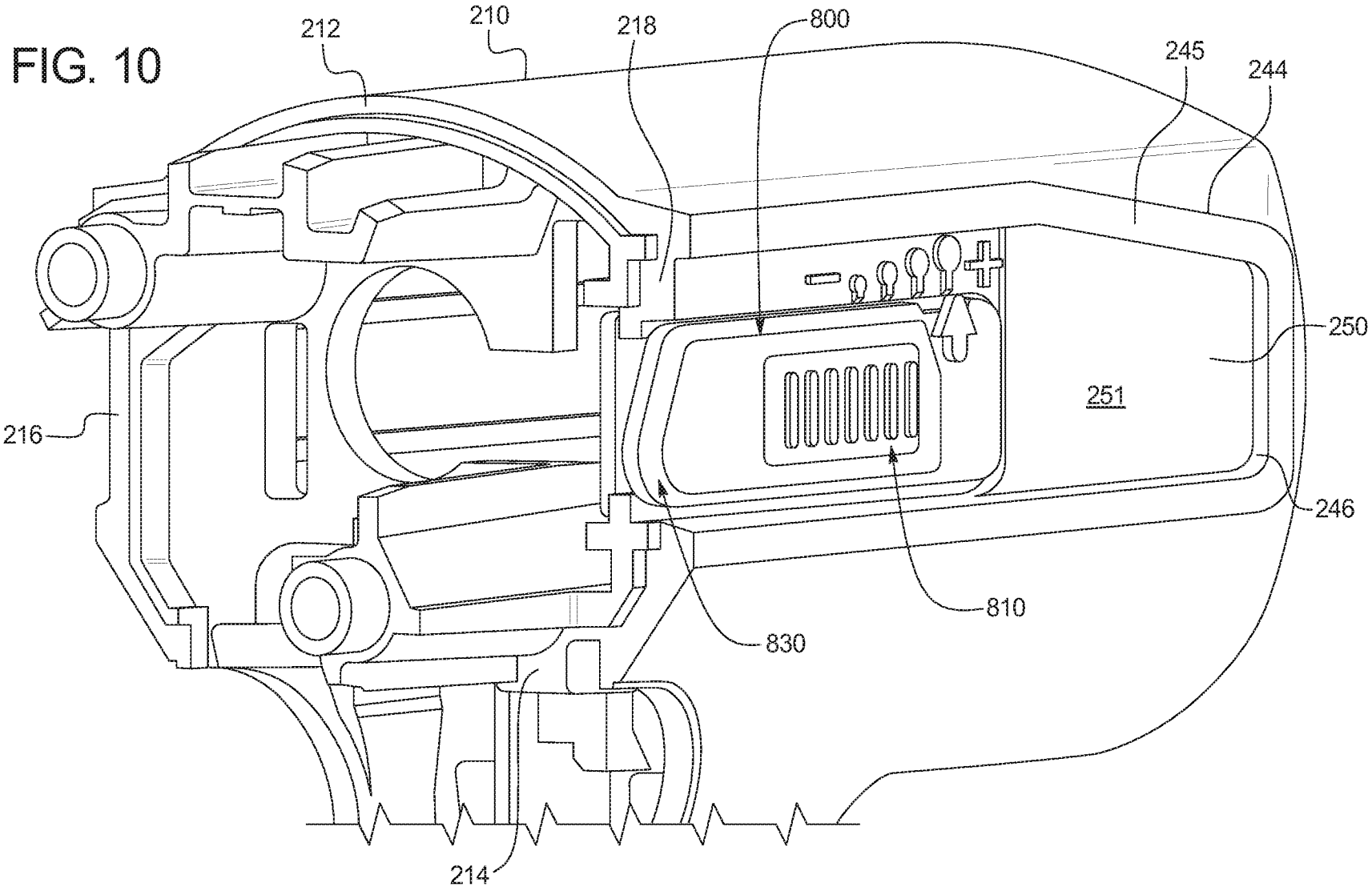
FIG. 10 is an enlarged fragmentary cross sectional view of the housing of the powder-actuated tool of FIG. 1, further showing the position of the spring-loaded slidable power setting switch with respect to the housing.

The third or recessed section 250 has an outer surface 251 that extends in a second plane of the housing on the right side of the powder-actuated tool 100. This second plane is inwardly spaced apart from the first or outermost plane relative to the generally tubular outer housing 210. The third or recessed section 250 defines a longitudinally-extending opening 260 as best seen in FIG. 9.

The spring-loaded slidable power setting switch 800 in this illustrated embodiment generally includes a depressible button 810, a slider 830, a locking member 850, a spring 870, an actuation member 880, and an assembly pin 890 as best shown in FIGS. 10, 11A, 11B, 12, and 13.

The depressible button 810 includes a generally rectangular body 812 having a front side 813 and a back side 815. The depressible button 810 includes a plurality of outwardly extending ridges 816 that respectively have outer surfaces that lie in a same vertically or substantially extending plane. The button 810 also includes a back section 820.

The slider 830 includes an outer wall 833 connected to an inner wall 834 by a connecting wall 835. The outer wall 833 extends on the outer side of the housing 210 and particularly on the outer side of outer surface 251. The inner wall 834 extends on the inner side of the housing and particularly on the inner side of outer surface 251. The slider 830 defines an opening 837 through which the back section 820 of the button 810 extends.

The locking member 850 includes a body 852 and a front section 854 extending from the body 852. The front section 854 is sized, shaped, or otherwise configured to extend into the opening 837 in the slider 830. The locking member 850 further includes first and second or top and bottom locking tabs or arms 856 and 857 that extend from the body 852 and that are sized, shaped, or otherwise configured to engage slots (not shown) in the wall 218 of the housing 210.

The spring 870 is disposed around the assembly pin 890, biases the locking member 850 toward its outwardly-extending position, and biases the button 810 toward its outwardly-extending position.

The actuation member 880 includes a body 882 and an actuation arm 884 extending from the body 882. The actuation arm 884 is configured to engage an assembly to change the power of the powder-actuated tool 100.

The assembly pin 890 extends through the actuation member 880, the spring 890, the locking member 850, and the slider 830, and is threadably (or otherwise) attached to the back section 820 of the button 810 to join and hold these components together.

Figure 11A:
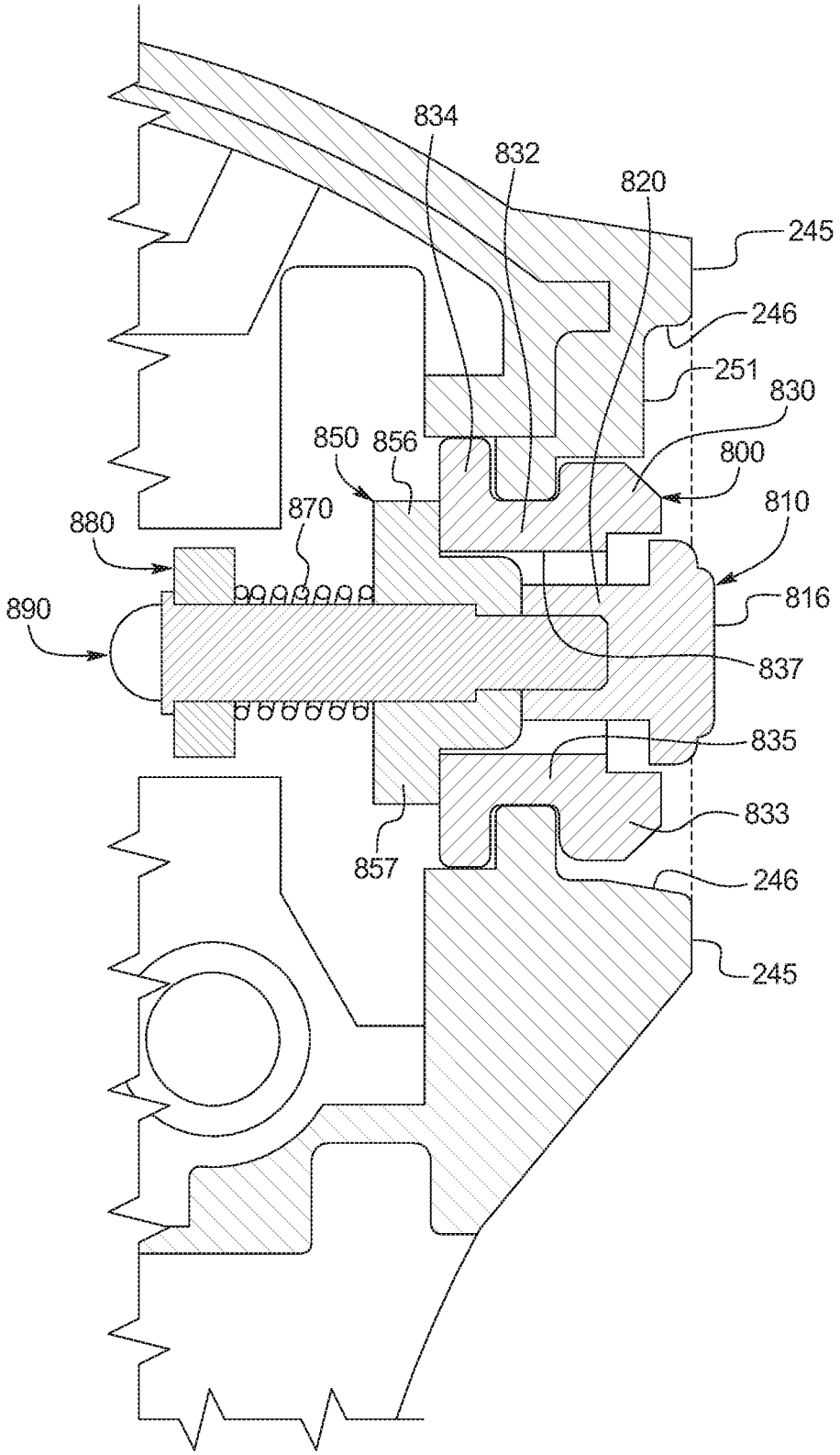
FIG. 11A is an enlarged fragmentary cross sectional view of the housing and the spring-loaded slidable power setting switch of the powder-actuated tool of FIG. 1, further showing the position of the spring-loaded slidable power setting switch with respect to the housing, and further showing the button of the switch in a resting position.
Figure 11B:
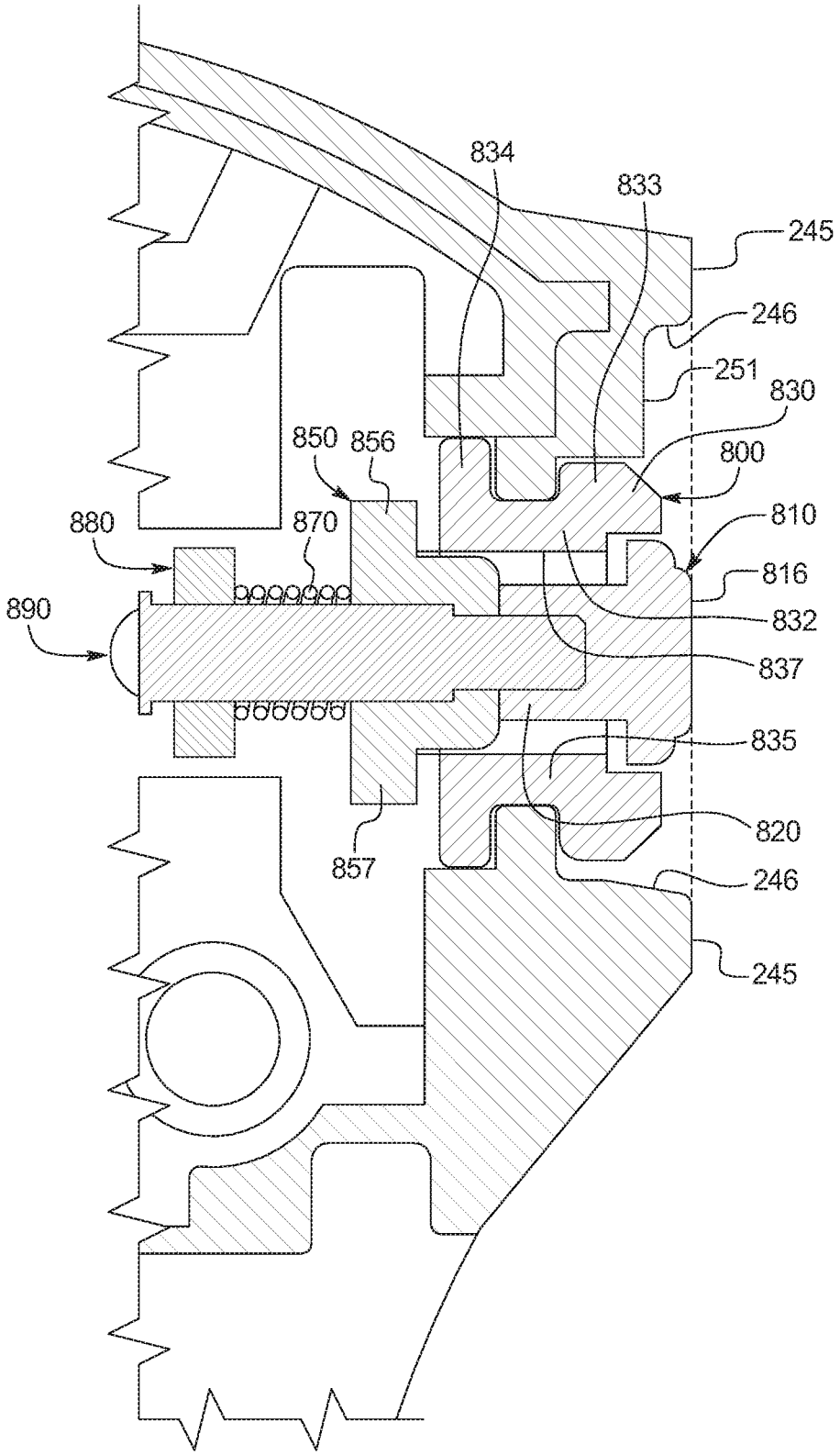
FIG. 11B is an enlarged fragmentary cross sectional view of the housing and the spring-loaded slidable power setting switch of the powder-actuated tool of FIG. 1, further showing the position of the spring-loaded slidable power setting switch with respect to the housing, and further showing the button of the switch in a depressed position.
Figure 12:
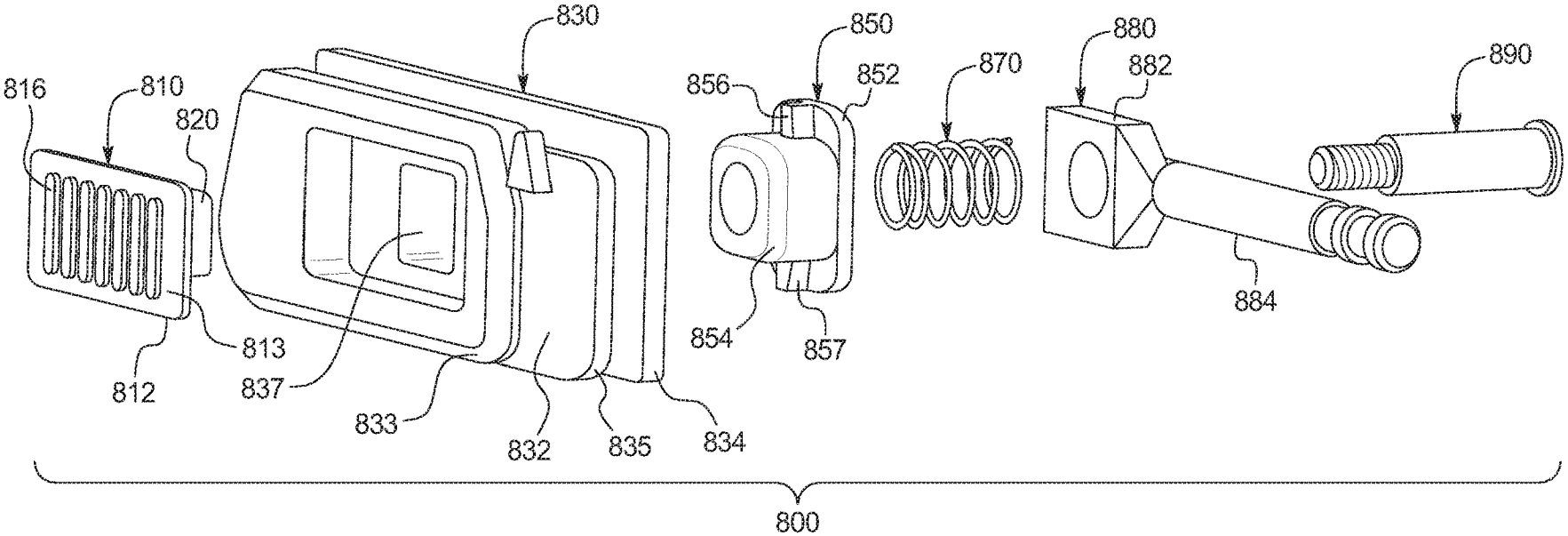
FIG. 12 is an enlarged exploded front view of the spring-loaded slidable power setting switch of the powder-actuated tool of FIG. 1.
Figure 13:
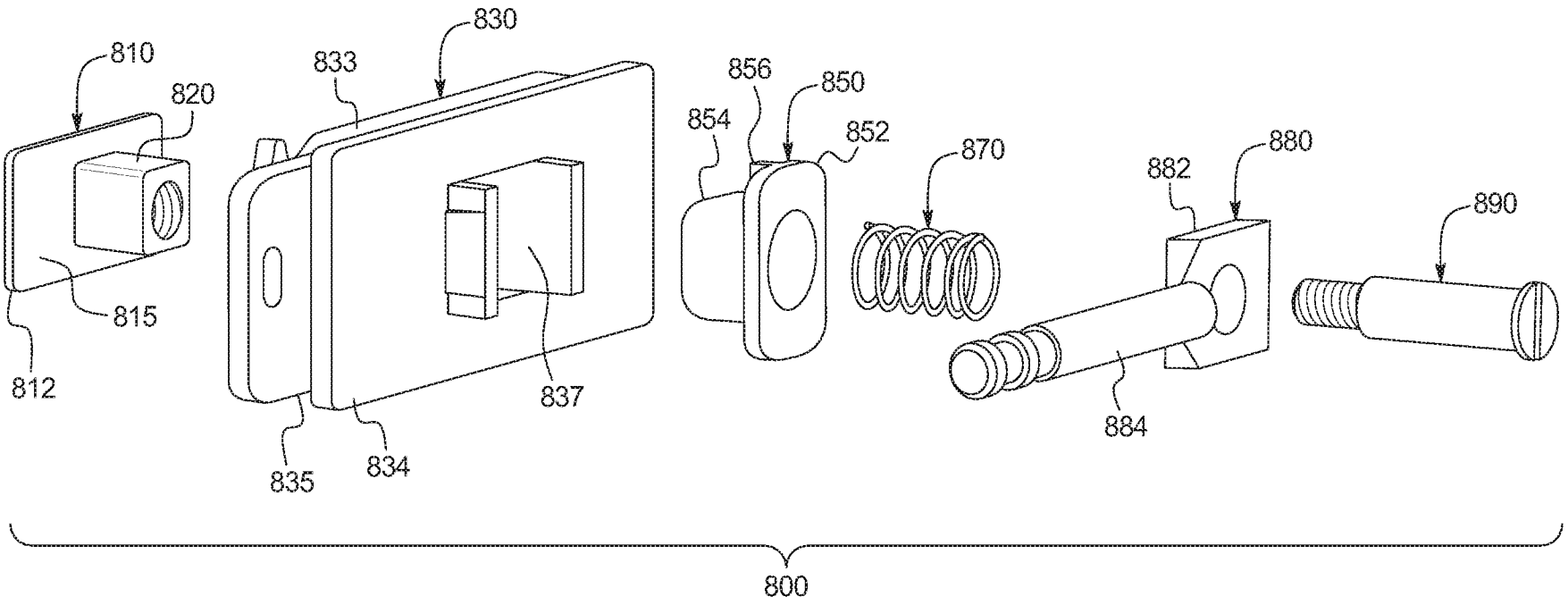
FIG. 13 is an enlarged exploded rear view of the spring-loaded slidable power setting switch of the powder-actuated tool of FIG. 1.

The depressible button 810 is movable from: (1) a first or resting position as shown in FIG. 11A, to (2) a second or depressed position as shown in FIG. 11B. In the first position, the ridges 816 of the button 810 extend outwardly beyond the plane in which the outer surface 245 of the rim 244 lies as shown in FIGS. 4, 5, 6, 7, and 11A, and as indicated by the dotted line in FIG. 11A. In the second position, the ridges 816 of the button 810 extend in the same or substantially the same plane in which the outer surface 245 of the rim 244 lies as specifically indicated by the dotted line in FIG. 11B. Put differently, in the second position, the outermost surface(s) of the button 810 (the ridges in this illustrated embodiment) are substantially coplanar with the outermost surface of the rim 244 (the outer surface 245 in this illustrated embodiment).

The locking member 850 is movable from: (1) a first or resting position as shown in FIG. 11A in which the locking member 850 engages the housing such that the slider 830 cannot side relative to the housing; to (2) a second position as shown in FIG. 11B in which the locking member 850 does not engage the housing such that the slider 830 can side relative to the housing. In this second position, the slider is movable relative to the housing to adjust the power setting for the powder-actuated tool 100.

Thus, in this illustrated embodiment, the spring-loaded slidable power setting switch 800 including the button 810 is positioned such that the outer surface or surfaces of the button 810 (in this illustrated embodiment, the outer surfaces of the ridges 816 of the button 810) extend(s) in a plane further outwardly than the first or outermost plane of the housing 210 on the right side of the powder-actuated tool 100 (as best shown in FIG. 11A), and is depressible inwardly to a point at which the outer surface of the button 810 (in this illustrated embodiment, the outer surfaces of the ridges 816 of the button 810) extend(s) in the same or substantially the same first or outermost plane on the right side of the powder-actuated tool 100 (as best shown in FIG. 11B).

By being depressible inwardly to a point at which the outer surface(s) of the button 810 extend(s) in the same first or outermost plane on the right side of the powder-actuated tool 100, the button 810 (and the entire switch 800) is protected from damage. For instance, if the powder-actuated tool 100 falls on the ground and lands on its right side, the weight of the powder-actuated tool 100 will depress the button 810 inwardly until the outer surfaces of the ridges 816 align with the outer surface 245 of the outer rim 244. At that point, the outer surface 245 of the outer rim 244 will engage the ground and prevent further substantial inward movement of the button 810.

The use of the outer rim 244 therefore enables the button 810 to extend outwardly from housing assembly 110 and remain easily accessible for the operator to change the power level of the powder-actuated tool 100 while also preventing the button 810 from accidental over-depression when the right side of the powder-actuated tool 100 is engaged by the ground or other substantial object.

Figure 14:
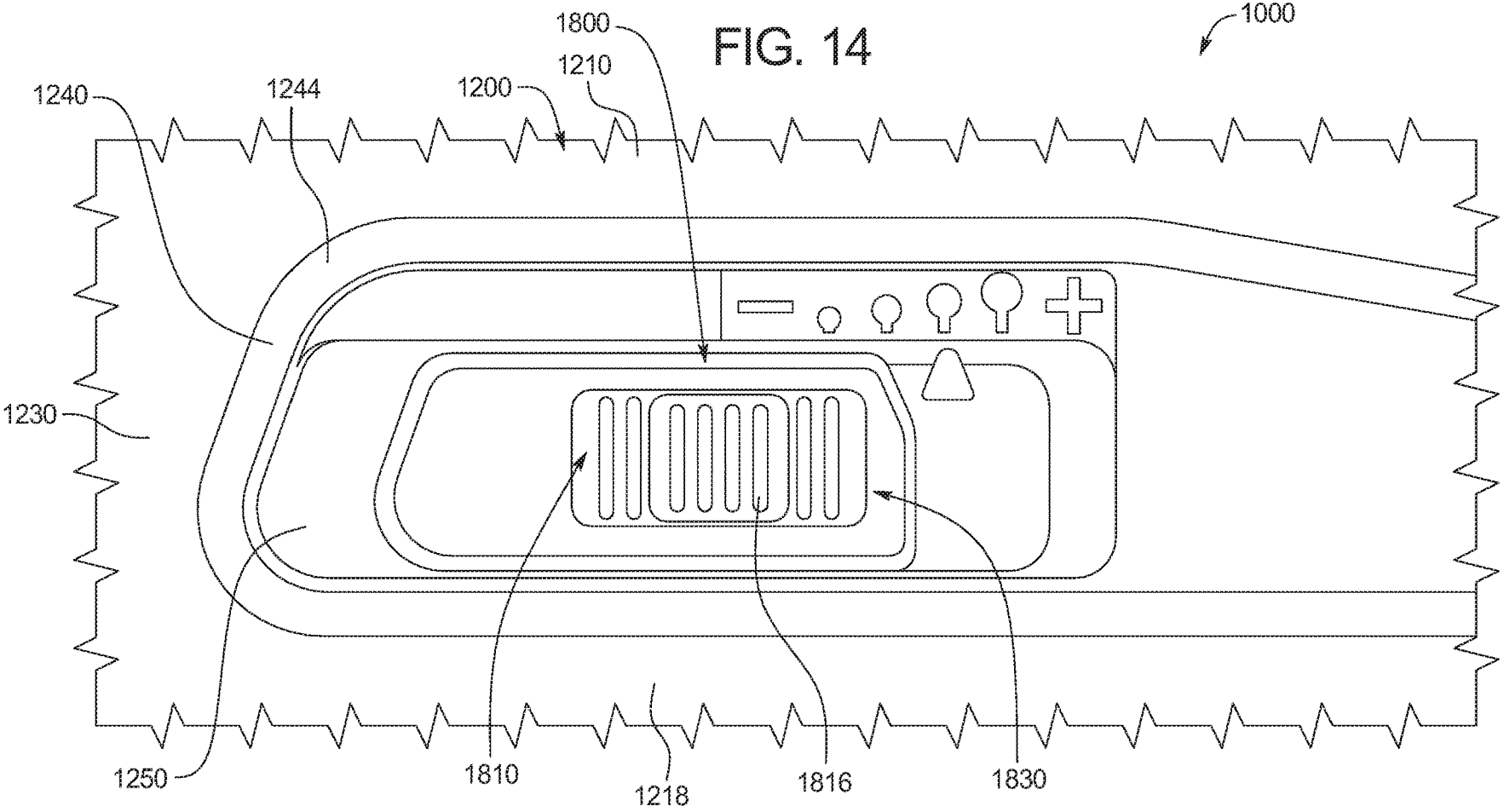
FIG. 14 is an enlarged fragmentary right side view of the powder-actuated tool of an alternative embodiment off the present disclosure, showing the position of the spring-loaded slidable power setting switch with respect to the housing.

Referring now to FIG. 14, the powered fastener driving tool of another example embodiment of the present disclosure is generally illustrated and indicated by numeral 1000.

The powered fastener driving tool and particularly the powder-actuated tool 1000 of this illustrated example embodiment generally includes: (a) a housing assembly (not labeled) including a main compartment assembly 1200 and a handle assembly (Not shown) extending from the main compartment assembly 200: (b) a power source or supply assembly (not shown) positioned in the housing assembly and configured to use loads attached to a load strip that moves through the handle assembly and main compartment assembly 1200, the power source or supply assembly adjustable between a plurality of different power levels; (d) a fastener supply assembly configured to receive fasteners (not shown) and positioned in the housing assembly; (e) a fastener driving assembly (not shown) positioned in the housing assembly; (f) a trigger mechanism assembly (not shown) connected to or supported by the handle assembly of the housing assembly; (g) a WOE assembly (not shown) connected to or supported by the housing assembly; and (h) a spring-loaded slidable power setting switch 1800 partially positioned in and partially extending from the main compartment assembly 1200 of the housing assembly.

More specifically, the housing assembly includes a main compartment assembly 1200 and a handle assembly extending downwardly from the main compartment assembly 1200. In this illustrated embodiment, the main compartment assembly 1200 includes a generally tubular outer housing 1210 including a top wall (not shown), a bottom wall (not shown), a left side wall (not shown), and a right side wall 1218 integrally formed or connected. The right side wall 1218 includes a first outer section 1230, a second or raised section 1240, and a third or recessed section 1250. The second or raised section 1240 includes a ridge or rim 1244.

The spring-loaded slidable power setting switch 1800 in this illustrated example embodiment generally includes a depressible button 1810, a slider 1830, a locking member (not shown), a spring (not shown), an actuation member (not shown), and an assembly pin (not shown). The depressible button 1810 includes a generally rectangular body having a front side and a back side. The depressible button 1810 includes a plurality of outwardly extending ridges 1816 that respectively have outer surfaces that lie in a same vertically or substantially extending plane.

The depressible button 1810 is movable from: (1) a first or resting position; to (2) a second or depressed position. In the first position, the ridges 816 of the button 810 extend outwardly beyond the plane in which the outer surface of the rim 1244 lies. In the second position, the ridges 1816 of the button 1810 extend in the same or substantially the same plane in which the outer surface of the rim 1244 lies. Put differently, in the second position, the outermost surface(s) of the button 1810 (the ridges in this illustrated embodiment) are substantially coplanar with the outermost surface of the rim.

Thus, in this illustrated embodiment, the spring-loaded slidable power setting switch 1800 including the button 1810 is positioned such that the outer surface or surfaces of the button 1810 (in this illustrated embodiment, the outer surfaces of the ridges 1816 of the button 1810) extend(s) in a plane further outwardly than the first or outermost plane of the housing 1210 on the right side of the powder-actuated tool 1100, and is depressible inwardly to a point at which the outer surface of the button 1810 (in this illustrated embodiment, the outer surfaces of the ridges 1816 of the button 1810) extend(s) in the same or substantially the same first or outermost plane on the right side of the powder-actuated tool 1100.

By being depressible inwardly to a point at which the outer surface(s) of the button 1810 extend(s) in the same first or outermost plane on the right side of the powder-actuated tool 1100, the button 1810 (and the entire switch 1800) is protected from damage. For instance, if the powder-actuated tool 1100 falls on the ground and lands on its right side, the weight of the powder-actuated tool 1100 will depress the button 1810 inwardly until the outer surfaces of the ridges 1816 align with the outer surface of the outer rim 1244. At that point, the outer surface of the outer rim 1244 will engage the ground and prevent further substantial inward movement of the button 1810.

The use of the outer rim 1244 therefore enables the button 1810 to extend outwardly from housing assembly 1110 and remain easily accessible for the operator to change the power level of the powder-actuated tool 1100 while also preventing the button 1810 from accidental over-depression when the right side of the powder-actuated tool 1100 is engaged by the ground or other substantial object.

It should also be appreciated that in alternative embodiments of the present disclosure, the outer surfaces of the ridges of the button extend, when depressed, in a lower plane than or below the outermost plane on the powder-actuated tool.

It should be appreciated from this alternative embodiment that the slider and button configurations may vary in accordance with the present disclosure.

It should be appreciated from the above that in various embodiments the present disclosure provides a powered fastener driving tool comprising: (a) a housing assembly including a main compartment assembly and a handle assembly extending from the main compartment assembly, the main compartment assembly including a side wall, the side wall including a first outer section, a raised section, and a recessed section, the raised section including a rim having an outer surface that extends in an outermost plane of the side wall of the main compartment assembly; (b) a power supply assembly positioned in the housing assembly; (c) a fastener supply assembly configured to receive fasteners and positioned in the housing assembly; (d) a fastener driving assembly positioned in the housing assembly; (e) a trigger mechanism assembly supported by the handle assembly; (f) a workpiece contact element assembly supported by the housing assembly; and (g) a spring-loaded slidable power setting switch partially positioned in and partially extending from the main compartment assembly, the spring-loaded slidable power setting switch including a depressible button movable from: (i) a resting position in which an outer surface of the button extends outwardly beyond the plane in which the outer surface of the rim lies, to (ii) a depressed position in which the outer surface of the button extends in a same or substantially same plane in which the outer surface of the rim lies.

In certain such embodiments, the raised section includes an outwardly-extending section, the rim, and an inwardly-extending section.

In certain such embodiments, the outwardly-extending section extends from the first outer section to the rim.

In certain such embodiments, the inwardly-extending section extends from the rim to the recessed section.

In certain such embodiments, the rim extends from an outermost edge of the outwardly-extending section to an outermost edge of the inwardly-extending section.

In certain such embodiments, the spring-loaded slidable power setting switch also includes a slider, a locking member, a spring, an actuation member, and an assembly pin.

In certain such embodiments, the depressible button includes a generally rectangular body having a front side and a back side, and a plurality of outwardly extending ridges that respectively have outer surfaces that lie in a same or substantially same extending plane.

In certain such embodiments, the powered fastener driving tool is powder-actuated.

It should also be appreciated from the above that in various embodiments the present disclosure provides powered fastener driving tool comprising: (a) a housing assembly including a main compartment assembly and a handle assembly extending from the main compartment assembly; the main compartment assembly including a side wall, the side wall including a first outer section, a raised section, and a recessed section, the raised section including an outwardly-extending section, a rim having an outer surface that extends in an outermost plane of the side wall of the main compartment assembly, and an inwardly-extending section, wherein the outwardly-extending section extends from the first outer section to the rim, the inwardly-extending section extends from the rim to the recessed section, and the rim extends from an outermost edge of the outwardly-extending section to an outermost edge of the inwardly-extending section; (b) a power supply assembly positioned in the housing assembly; (c) a fastener supply assembly configured to receive fasteners and positioned in the housing assembly; (d) a fastener driving assembly positioned in the housing assembly; (e) a trigger mechanism assembly supported by the handle assembly; (f) a workpiece contact element assembly supported by the housing assembly; and (g) a spring-loaded slidable power setting switch partially positioned in and partially extending from the main compartment assembly and including a depressible button, a slider a locking member, a spring, an actuation member, and an assembly pin, the depressible button movable from: (i) a resting position in which an outer surface of the button extends outwardly beyond the plane in which the outer surface of the rim lies, to (ii) a depressed position in which the outer surface of the button extends in a same or substantially same plane in which the outer surface of the rim lies.

In certain such embodiments, the depressible button includes a generally rectangular body having a front side and a back side, and a plurality of outwardly extending ridges that respectively have outer surfaces that lie in a same or substantially same extending plane.

In certain such embodiments, the powered fastener driving tool is powder-actuated.

It should also be appreciated from the above that in various embodiments the present disclosure provides a powered fastener driving tool comprising: (a) a housing having a side wall including an outwardly-extending section, an inwardly-extending section, a rim spanning the outwardly-extending and inwardly-extending sections, and a recessed section bound by the inwardly-extending section, wherein the rim extends in an outermost plane of the side wall; (b) a power supply positioned in the housing assembly, the power supply adjustable, between a plurality of different power levels; and (c) a power setting switch supported by the housing and operably connected to the power supply, the power setting switch including a button at least partially extending from the housing, the button movable from: (1) a resting position in which an outer surface of the button extends outwardly beyond the plane in which the rim lies and in which the power setting switch is not movable relative to the housing, to (2) a depressed position in which the outer surface of the button is substantially coplanar with the plane in which the rim lies and in which the power setting switch is movable relative to the housing to adjust the power level of the power supply, the power setting switch including a biasing element that biases the button to the resting position.

In certain such embodiments, the powered fastener driving tool of is powder-actuated.

It should also be appreciated from the above that in various embodiments the present disclosure provides a powered fastener driving tool comprising: (a) a housing having a side wall including an outwardly-extending section, an inwardly-extending section, a rim spanning the outwardly-extending and inwardly-extending sections, and a recessed section bound by the inwardly-extending section, wherein the rim extends in an outermost plane of the side wall; (b) a power supply positioned in the housing assembly, the power supply adjustable between a plurality of different power levels; and (c) a power setting switch supported by the housing and operably connected to the power supply, the power setting switch including a button at least partially extending from the housing, the button movable from: (1) a resting position in which an outer surface of the button extends outwardly beyond the plane in which the rim lies and in which the power setting switch is not movable relative to the housing, to (2) a depressed position in which the outer surface of the button is below the plane in which the rim lies and in which the power setting switch is movable relative to the housing to adjust the power level of the power supply, the power setting switch including a biasing element that biases the button to the resting position.

In certain such embodiments, the powered fastener driving tool is powder-actuated.

It will be understood that modifications and variations may be effected without departing from the scope of the novel concepts of the present invention, and it is understood that this application is to be limited only by the scope of the claims.

The invention is claimed as follows:

1. A powered fastener driving tool comprising:

(a) a housing assembly including a main compartment assembly and a handle assembly extending from the main compartment assembly, the main compartment assembly including a side wall, the side wall including a first outer section, a raised section, and a recessed section, the raised section including a rim having an outer surface that extends in an outermost plane of the side wall of the main compartment assembly;

(b) a power supply assembly positioned in the housing assembly;

(c) a fastener supply assembly configured to receive fasteners and positioned in the housing assembly;

(d) a fastener driving assembly configured to drive a fastener in a first direction along a longitudinal axis of the fastener driving assembly and positioned in the housing assembly, the fastener driving assembly having a first longitudinal end and a second longitudinal end opposite the first longitudinal end, wherein the first direction is toward the first longitudinal end;

(e) a trigger mechanism assembly supported by the handle assembly;

(f) a workpiece contact element assembly supported by the housing assembly; and (g) a spring-loaded slidable power setting switch partially positioned in and partially extending from the main compartment assembly, the spring-loaded slidable power setting switch being movable from a first position to a second position, wherein the second position is closer to the first longitudinal end of the fastener driving assembly than the first position;

wherein the spring-loaded slidable power setting switch includes a depressible button movable in a second direction that is transverse to the first direction from: (i) a resting position in which an outer surface of the depressible button extends outwardly beyond the plane in which the outer surface of the rim lies, to (ii) a depressed position in which the outer surface of the depressible button extends in a same or substantially same plane in which the outer surface of the rim lies.

2. The powered fastener driving tool of claim 1, wherein the raised section includes an outwardly-extending section, the rim, and an inwardly-extending section.

3. The powered fastener driving tool of claim 2, wherein the outwardly-extending section extends from the first outer section to the rim.

4. The powered fastener driving tool of claim 3, wherein the inwardly-extending section extends from the rim to the recessed section.

5. The powered fastener driving tool of claim 4, wherein the rim extends from an outermost edge of the outwardly-extending section to an outermost edge of the inwardly-extending section.

6. The powered fastener driving tool of claim 1, wherein the spring-loaded slidable power setting switch also includes a slider, a locking member, a spring, an actuation member, and an assembly pin.

7. The powered fastener driving tool of claim 1, wherein the depressible button includes a substantially rectangular body having a front side and a back side, and a plurality of outwardly extending ridges that respectively have outer surfaces that lie in a same or substantially same extending plane.

8. The powered fastener driving tool of claim 1, which is powder-actuated.

9. A powered fastener driving tool comprising:

(a) a housing assembly including a main compartment assembly and a handle assembly extending from the main compartment assembly, the main compartment assembly including a side wall, the side wall including a first outer section, a raised section, and a recessed section, the raised section including an outwardly-extending section, a rim having an outer surface that extends in an outermost plane of the side wall of the main compartment assembly, and an inwardly-extending section, wherein the outwardly-extending section extends from the first outer section to the rim, the inwardly-extending section extends from the rim to the recessed section, and the rim extends from an outermost edge of the outwardly-extending section to an outermost edge of the inwardly-extending section;

(b) a power supply assembly positioned in the housing assembly;

(c) a fastener supply assembly configured to receive fasteners and positioned in the housing assembly;

(d) a fastener driving assembly configured to drive a fastener in a first direction along a longitudinal axis of the fastener driving assembly and positioned in the housing assembly, the fastener driving assembly having a first longitudinal end and a second longitudinal end opposite the first longitudinal end, wherein the first direction is toward the first longitudinal end;

(e) a trigger mechanism assembly supported by the handle assembly;

(f) a workpiece contact element assembly supported by the housing assembly; and (g) a spring-loaded slidable power setting switch partially positioned in and partially extending from the main compartment assembly, the spring-loaded slidable power setting switch being movable from a first position to a second position, wherein the second position is closer to the first longitudinal end of the fastener driving assembly than the first position;

wherein the spring-loaded slidable power setting switch includes a depressible button, a slider, a locking member, a spring, an actuation member, and an assembly pin, the depressible button movable in a second direction that is transverse to the first direction from: (i) a resting position in which an outer surface of the depressible button extends outwardly beyond the plane in which the outer surface of the rim lies, to (ii) a depressed position in which the outer surface of the depressible button extends in a same or substantially same plane in which the outer surface of the rim lies.

10. The powered fastener driving tool of claim 9, wherein the depressible button includes a substantially rectangular body having a front side and a back side, and a plurality of outwardly extending ridges that respectively have outer surfaces that lie in a same or substantially same extending plane.

11. The powered fastener driving tool of claim 9, which is powder-actuated.

12. A powered fastener driving tool comprising:

(a) a housing having a first longitudinal end and a second longitudinal end opposite the first longitudinal end, wherein the powered fastener driving tool is configured to drive a fastener toward the first longitudinal end, the housing having a side wall including an outwardly-extending section, an inwardly-extending section, a rim spanning the outwardly-extending and inwardly-extending sections, and a recessed section bound by the inwardly-extending section, wherein the rim extends in an outermost plane of the side wall;

(b) a power supply positioned in the housing assembly, the power supply adjustable between a plurality of different power levels; and (c) a power setting switch supported by the housing and operably connected to the power supply, the power setting switch being slidably movable in a first direction from a first position to a second position, wherein the second position is closer to the first longitudinal end of the housing than the first position;

wherein the power setting switch includes a depressible button at least partially extending from the housing, the depressible button movable in a second direction that is transverse to the first direction from: (1) a resting position in which an outer surface of the depressible button extends outwardly beyond the plane in which the rim lies and in which the power setting switch is not slidably movable relative to the housing, to (2) a depressed position in which the outer surface of the depressible button is substantially coplanar with the plane in which the rim lies and in which the power setting switch is slidably movable relative to the housing to adjust the power level of the power supply, the power setting switch including a biasing element that biases the depressible button to the resting position.

13. The powered fastener driving tool of claim 12, which is powder-actuated.

* * * * *